US007192342B2

(12) United States Patent
Shoemaker, Jr.

(10) Patent No.: US 7,192,342 B2
(45) Date of Patent: Mar. 20, 2007

(54) CRANE GAME WITH TICKET DISPENSER

(76) Inventor: Stephen P. Shoemaker, Jr., 531 N. Francisca Ave., Redondo Beach, CA (US) 90277

( * ) Notice: Subject to any disclaimer, the term of this patent is extended or adjusted under 35 U.S.C. 154(b) by 600 days.

(21) Appl. No.: 10/645,207

(22) Filed: Aug. 21, 2003

(65) Prior Publication Data

US 2005/0043073 A1 Feb. 24, 2005

(51) Int. Cl.
*A63F 9/24* (2006.01)

(52) U.S. Cl. ..... 463/7; 273/447; 273/138.3; 273/402

(58) Field of Classification Search ..... 463/7, 463/36, 37; 446/132
See application file for complete search history.

(56) References Cited

U.S. PATENT DOCUMENTS

| | | | | |
|---|---|---|---|---|
| 5,704,612 | A * | 1/1998 | Kelly et al. | 273/402 |
| 5,713,572 | A * | 2/1998 | Hagiwara | 273/138.3 |
| 5,855,374 | A * | 1/1999 | Shoemaker, Jr. | 273/447 |
| 6,283,475 | B1 * | 9/2001 | Stubben | 273/448 |
| 6,899,337 | B2 * | 5/2005 | Fisher et al. | 273/447 |
| 2003/0100255 | A1 * | 5/2003 | Allison | 453/14 |

* cited by examiner

*Primary Examiner*—Xuan M. Thai
*Assistant Examiner*—Alan Cross
(74) *Attorney, Agent, or Firm*—Fulwider Patton LLP

(57) ABSTRACT

An amusement device characterized by a crane mechanism maneuverable within a target bin by a player includes targets having a circular profile of varying diameters. A game value is associated with each target according to the diameter size of the target, and a ticket dispenser is provided for dispensing tickets of a number or value corresponding to the value of a captured target value.

4 Claims, 3 Drawing Sheets

CRANE GAME WITH TICKET DISPENSER

BACKGROUND OF THE INVENTION

1. Field of the Invention

The present invention relates generally to amusement devices generally referred to as crane games, and more particularly to a crane game that dispenses redeemable tickets as a reward for the successful capture of a target by the crane game player.

2. Description of Related Art

Crane-type games are popular amusement devices often provided in arcades, stores, restaurants, pubs, and other public places. In these games, prizes are provided within an enclosed housing and are viewable by a player through transparent glass window. Upon the insertion of a coin or token into the game, the player maneuvers a crane including at an end an acquisition device (mechanical claw, magnet, vacuum head, etc.) using controls on the front panel such as a joystick, buttons, trac-ball, or the like. Typically, the crane is located above a collection of prizes and the player can position the crane horizontally over the prizes. The acquisition device is then lowered from the crane toward the prizes by the player as the player attempts to capture a prize below. The claw, vacuum, magnet, or the like is actuated when in proximity with the prizes to grasp, adhere, or otherwise attach to the prize. The acquisition device is then raised above the prizes and any prizes captured by the crane is picked up by the acquisition device.

The player may or may not be successful in capturing a prize as the crane returns to a position above the prizes and automatically moves over an extraction chute. The acquisition means is released, allowing the prize (if any is held) to drop into the extraction chute where it falls into a compartment accessible by the player. In a common implementation, a sensor within the dispenser detects whether a prize has been won by the player, prompting music to be played or lights to flash. After the game has ended, the controller moves the crane to its original starting position and waits for another insertion of the coin (unless the player is provided with multiple tries).

The crane game has enjoyed much success and is an excellent combination of skill and chance that allows players to test their skill and rewards skill with the player's choice of prizes. One drawback of the game, however, is that the game requires constant replenishment of the prizes in the prize bin to replace the prizes removed by the successful players. The owner or caretaker of the game must constantly monitor the game's prizes because the rate of extraction varies from day to day. Also, certain prizes may be more highly sought after than others, and this fact may result in the caretaker having to sort through the prizes in the bin to determine which prizes are more popular and which prizes should be used to repopulate the prize bin. If multiple crane games are present, as may be the case in an arcade or other similar location, the taking of inventory and replenishing of prizes can consume a considerable amount of time.

SUMMARY OF THE INVENTION

The present invention is characterized by a crane game that dispenses redeemable tickets for the successful capture of a target from the target bin. Targets extracted from the target bin by successful play do not leave the enclosed space defining the game's playing area, but rather are returned to the target pile after the game confirms a successful capture of the target. In a preferred embodiment, the targets each are assigned a point value, and the redeemable tickets are dispensed according to the target's point value. The crane game of the present invention avoids the depletion of targets resulting from successful game play, so the targets do not need replenishing.

In a preferred embodiment, spherical targets are collected on a rotating playing field while a crane is maneuvered across the playing field by a start/stop button. The targets are of varying sizes and point values, where degree of difficulty in acquiring the targets is dependent upon the target's diameter. Once the crane is maneuvered into position, the crane is lowered and a suction cup is provided to make contact with a spherical target and a pump provides suction to capture the intended target once contact is achieved. The crane is then raised and the target placed on a horizontally inclined track divided into a series of stations. A groove runs longitudinally along the center of the track for carrying the spherical targets down the track. At a first station, the groove widens incrementally to a spacing that allows the smallest size target to fall through the groove while permitting all other size targets to roll along the edges of the groove. A pair of sensors detects an interruption in a beam of light passing below the first station, and generates a signal unique to the first station that is communicated to a ticket dispensing machine. The ticket dispensing machine then dispensing tickets to the player according to a predetermined exchange for successful capture of the smallest target. The target, having fallen through the groove and been detected by the sensor, is returned to the collection of targets for future play.

Each successive station widens incrementally with respect to the previous station to allow only one size target to fall through the groove, and each station includes a pair of sensors that generates a unique signal for that station that is communicated to the ticket dispensing machine. In each case, the ticket dispensing machine dispenses tickets according to the point value of the target before returning the target to the target pile. Tickets are thus awarded for displaying skill in acquiring the targets, and the tickets can be redeemed for prizes at a separate location where inventory and tracking can be centralized.

DETAILED DESCRIPTION OF THE PREFERRED EMBODIMENTS

Figure 1:
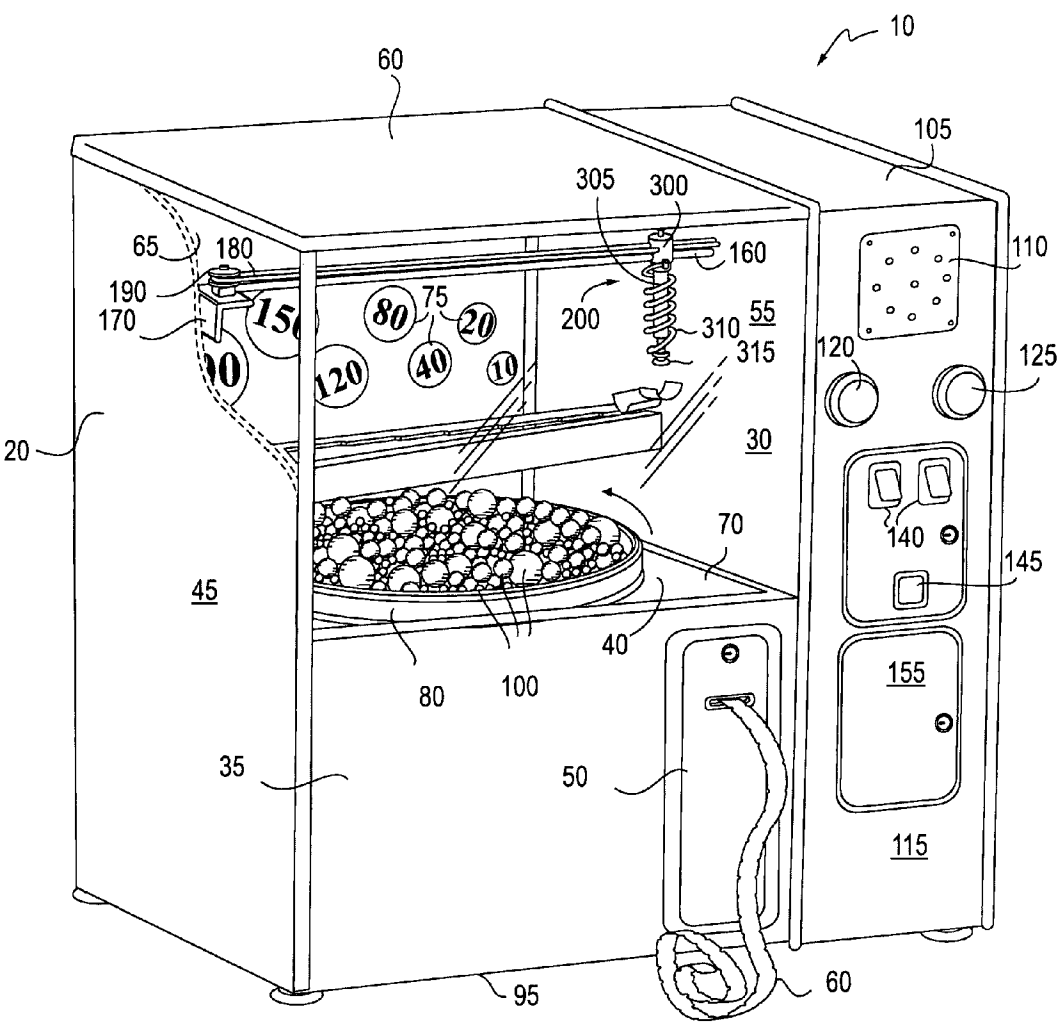
FIG. 1 is an elevated perspective view of a first preferred embodiment of the present invention.
Figure 2:
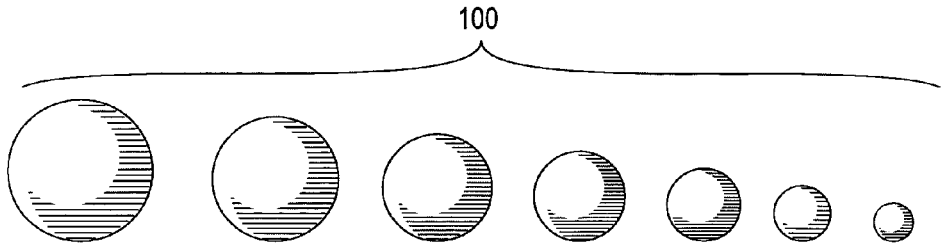
FIG. 2 is a comparative view of a representative set of targets for the crane game of FIG. 1.

The present invention is generally depicted in FIG. 1, illustrating a crane game 10 with a ticket dispenser 50 for dispensing redeemable tickets 60 in response to successful game play. The game 10 is encased in a housing 20 having a transparent window 30 along a front panel 35 providing observation of a playing field compartment 40 reserved for game play. The playing field compartment 40 is further defined by rigid left and right walls 45,55, a ceiling 60, a rear wall 65, and a floor 70. The rear wall 65 may be decorated with decals 75 or placards that represent the value of the respective targets, where each decal 75 is of a different color and the color of the decals match the color of the represented target. Below the playing field compartment 40 is a storage compartment that housing a ticket dispensing machine 50, such as a PN 42-0980-00 T-980 Ticket Dispenser from Happ Controls of Elk Grove, Ill. The storage compartment may also include a drive system (not shown) for rotating a turntable type playing field 80 carrying the multi-shaped, multi-colored targets 100. The mechanics and operation of the drive system are not pertinent to the present invention and are omitted from the present discussion.

A third compartment 105 is disposed adjacent the playing field compartment 40 and the storage compartment 95, and provides space for housing the electronics of the crane system, the controls, the coin collection, and the sound system if present. A speaker plate 110 with a plurality of holes is provided on the forward face 115 of the compartment 105 for playing music or sound effects, where a speaker (not shown) is mounted on the inside of the compartment adjacent the speaker plate 110. A pair of buttons 120, 125 control the movement of the crane 200 in the horizontal and vertical directions. In the present example, the crane 200 is mounted for movement in a linear direction while a turntable 80 of targets 100 continuously rotates below. Alternatively, the crane 200 can move in four directions (front, back, left, and right) below a stationary playing field. A pair of coin slots 140 and coin return 145 is provided on the front 115 of the compartment 105, and a locked door 155 encloses a coin collection receptacle (not shown) that collects coins (tokens) which drop down a passage from the coin slots 140 located above.

The playing field compartment 40 includes a vacuum crane 200 suspended from a beam 160 that spans the width of the playing field compartment. The beam 160 passes through the wall 30 between the adjacent compartments 40,105 and is secured at a far end by an L-shaped mounting bracket 170. Located above the beam 160 is a cable 180 mounted on a pulley 190, which itself is mounted on to the L-shaped bracket 170. The cable 180 is coupled to a motor located inside the compartment 105 for moving the cable on the pulley. The cable 180 is connected to and drives the crane 200 along the beam 160 linearly across the playing field compartment 40. That is, rotation of the cable 180 about the pulley 190 translates the crane 200 linearly along the beam 160 from one side to the other. Once the crane 200 reaches the far end of the playing field the direction of the cable 180 is reversed and the crane 200 returns toward the center of the playing field.

The movement of the crane is coupled to the controls 120 on the front panel. Pressing the button 120 corresponding to horizontal translation once actuates the motor to rotate the cable 180 and move the crane 200 across the field, and pressing the button 120 a second time halts the motor and fixes the crane's linear position. If the beam 160 is located above a diameter of the rotating turntable 80, then the entire area of the turntable is available because every point on the turntable rotates below a point on the beam coincident with a diameter of the turntable 80.

The crane 200 is comprised of a motor 300 that supports a cylindrical weight 305 and a vacuum head suspended by a retractable cable. A tubing 310 winds around the cylindrical weight 305 and terminates at the vacuum head 315 at one end and connects to a vacuum pump (not shown) at a second end. Suction is communicated from the pump to the vacuum head, characterized by a hemispherical plunger adapted to make contact with spherical targets 100. The pump evacuates the air from the interior of the plunger creating the suction of the vacuum head 315, such that when the plunger is placed in contact with a spherical (or other relatively smooth surface) target the vacuum head adheres to the target. As long as the suction is continuously applied to the vacuum head 315 while in contact with the target, the target will be captured and can be extracted by the player. The button 125 causes the crane 200 to lower the weighted vacuum head after the crane has been positioned horizontally, and the weight 305 and plunger 315 lowers along retractable cable. The sequence also causes the pump to activate and suction is administered to the vacuum head. Below the crane 200 is a plurality of balls 100 of varying size diameters, each diameter ball colored differently to easily distinguish the sizes.

When lowered the crane's vacuum head 315 can contact the ball and the removal of the air inside the vacuum head by the pump will cause the vacuum head to attach to the ball. This capturing of the ball (target) is the object of the game and results in tickets being dispersed through a ticket dispensing mechanism 50 located within the storage compartment 95. The tickets 60 are dispersed depending on the size of the target captured, with larger diameter balls having a higher value that when captured result in more tickets being dispensed The value of each target 100 can be displayed on the back wall 65 of the playing field compartment 40 with decals 75 or placards or a color matching the color of the respective balls. In other words, if the smallest diameter ball is blue, a decal in blue displays the point value for capturing the smallest diameter ball. In this way, the player is aware of what value each target represents and can prepare a strategy for capturing the targets.

The crane motor 300 retracts the cable after a short period and, if the crane captures a target, the target 100 is raised along with the crane 200. The crane is then maneuvered to a curved, upstanding channel 325 such that the target 100 is suspended over the channel (see FIGS. 3 and 4). The channel 325 is inclined such that a distal end 340 is lower than a proximal end 350, and is sized to receive the largest target in the playing field. Below the distal end 340 of the channel 325 is a chute 330 leading to a track 350 disposed above the rotating playing field 80. The track 350 is inclined such that a ball placed on the track after exiting the chute 330 will roll toward the far side 360 of the track due to gravity. A groove 370 is located in the track 350 to direct the ball along its designated path above the rotating turntable 80 that contains the targets 100. The groove 370 is defined by substantially parallel edges 380*a,b* spaced apart, and the distance between the edges widens incrementally along the path of the track 350. The distance between the edges 380*a,b* is initially at a first width that is smaller than the diameter of the smallest target, allowing all size balls to roll down the track within the groove. At a first station 12*a*, the width of the groove increases to a distance that is greater than the smallest diameter target but less than the next larger diameter. If the smallest ball (target) is captured and placed on the track 350, it will roll under the influence of gravity in the groove 370 until it reaches the first station 12*a*. Because the width of the groove 370 at the first station 12*a* is greater than the diameter of the smallest ball, the ball drops between the edges 380*a,b* that define the groove 370 into the collection of targets below. If the second smallest target is placed on the track, it rolls down the groove past the first station 12*a* and falls through the groove at the second station 12*b* where the distance between the edges is greater than the diameter of the second smallest ball.

At each station 12, the width of the groove 370 increases incrementally beyond the diameter of the next size target 100 such that each station allows only a single size target to fall through the groove. If a game includes seven size targets, then the groove 370 will include seven stations, and each station will include a corresponding increase in the width of the groove to permit one size target to fall between the spaced apart edges while allowing larger targets to roll across the station. Accordingly, each target acquired by the player and placed on the track 350 will roll down the track until it reaches the station designated for that target size, whereupon it will fall through the groove and reenter the target pile below.

Figure 3:
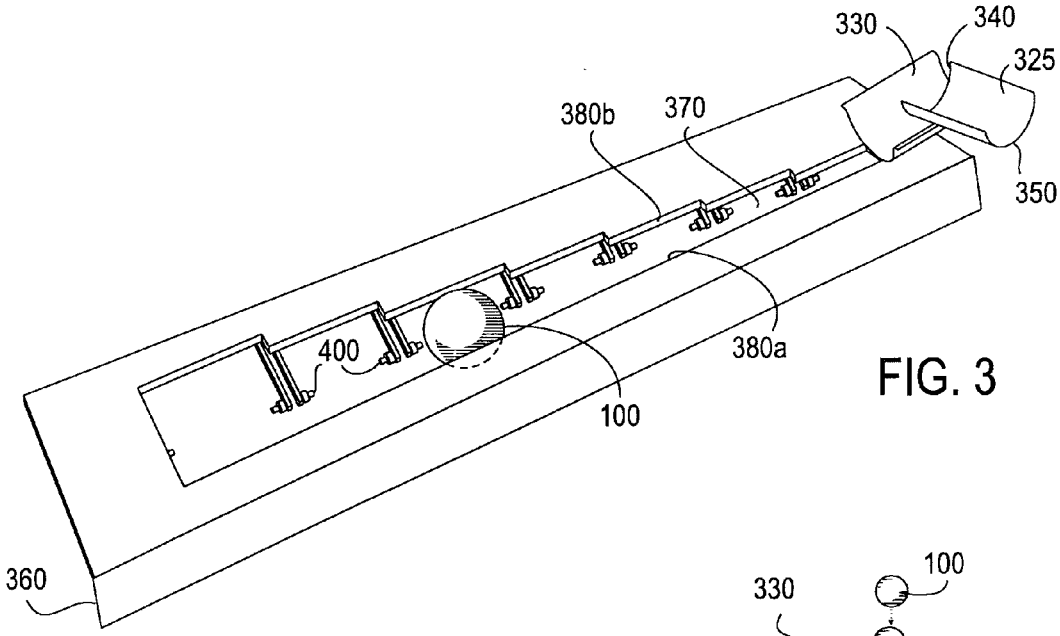
FIG. 3 is an elevated perspective view, enlarged for clarity, of the track and detectors of the crane game of FIG. 1.
Figure 4:
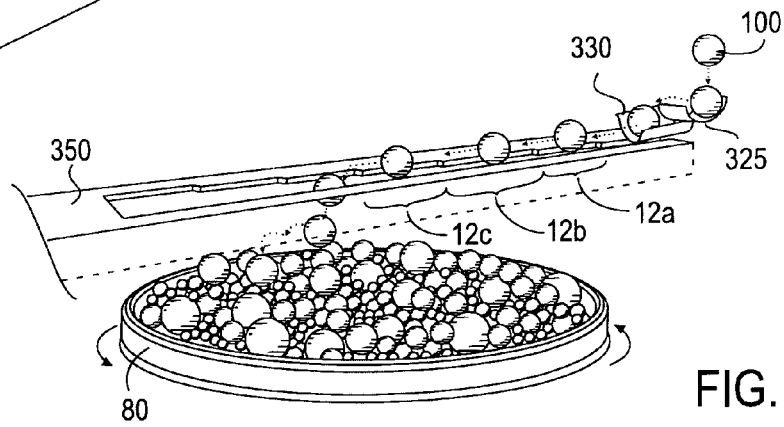
FIG. 4 is an elevated perspective view, enlarged for clarity, of the sequence of a target rolling on the track of FIG. 3 until the target reaches its designated station and falls through the track back to the collection of targets.
Figure 5:
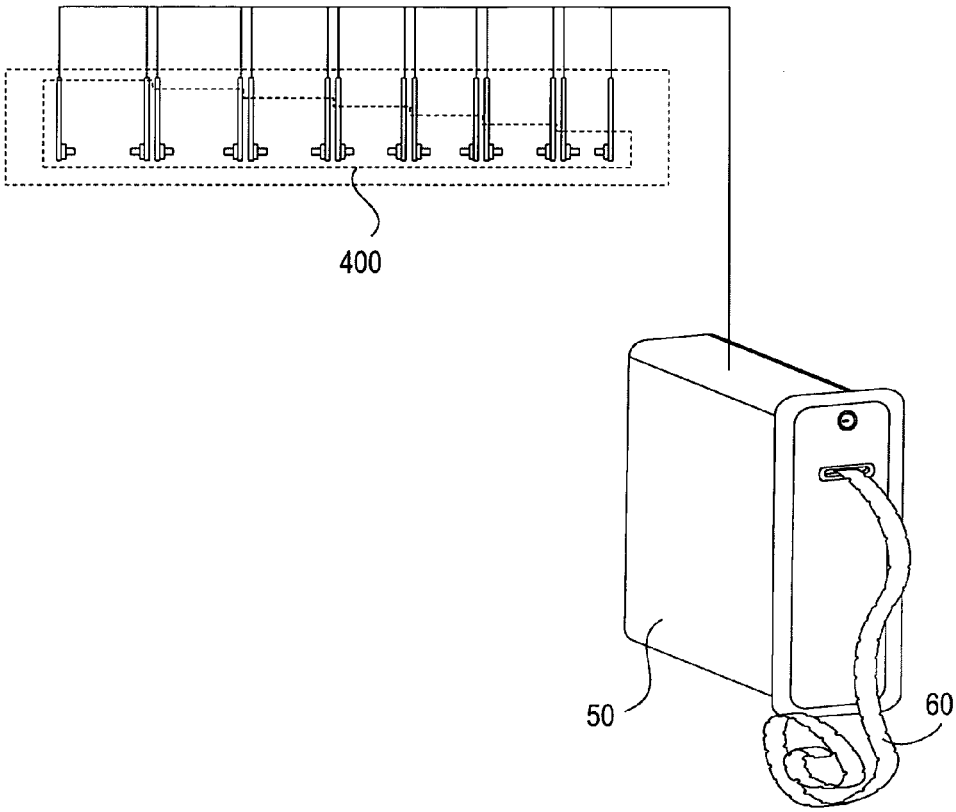
FIG. 5 is a schematic illustration of the series of detectors connected to a ticket dispensing machine in the crane game of FIG. 1.

Each station 12*a,b*, . . . is equipped with a detector mechanism 400 that perceives when a ball drops through a station on the track 350. As shown in FIG. 3, the detector mechanism 400 may be a pair of optical sensors that detect when a beam of light is broken between a light source and a light receiver, or an alternative detector such as a pivoting lever that moves downward under the weight of the dropping ball to close a circuit and generate a signal thereby. Other detector mechanisms are available to identify what size target has been acquired by the player without departing from the invention. The optical sensors 400 are connected to a ticket dispensing system 50 shown in FIG. 5. Each pair of sensors generate a different signal that is interpreted by the ticket dispensing system 50 as corresponding to a different value target.

The ticket dispensing mechanism 50 receives the signal and identifies the signal as originating from a particular station. The identification of the originating station is in turn interpreted by the ticket dispensing system as a command to deliver a particular number (or value) of tickets corresponding to the value associated with the particular target 100 captured and returned through the groove 370 in the track 350. For example, the smallest ball might return two five point tickets for a total of ten points, whereas the largest ball may return forty tickets of five points each for a two hundred point total. In this way, the difficulty of acquiring a target is matched with the reward in ticket value for its capture.

While the embodiment described above illustrates the principles of the present invention, it is intended only as an exemplary option and is not meant to limit the scope of the invention beyond the claims below. For example, while spherical targets are described above, disk shaped targets such as coins can be substituted in the present invention. A shaker or vibrational element may be needed in the case of non-spherical targets to orient the targets properly for measurement and return to the target area. As discussed, while a preferred mode of measuring the size of the targets has been disclosed, alternative modes are known to one of ordinary skill in the art and can be substituted without departing from the scope of the invention. The crane may employ a positioning mechanism that operates in two dimensions defining a horizontal plane above the target area, rather than a single dimension as disclosed. Alternative target acquisition modes can be substituted for the vacuum crane disclosed, as is known in the art. Other deviations from the preferred embodiments will be readily apparent to one of ordinary skill in the art, and such departures are to be considered within the scope of the present invention.

What is claimed is:

1. A crane game comprising:

a crane maneuverable within a target bin by a player and including acquisition means for capturing a target therein;

a plurality of targets disposed within the target bin, each said target having a value associated therewith;

a variable width inclined slot located above said target bin for establishing a diameter of a captured target, the variable width inclined slot comprising a plurality of stations longitudinally disposed along the slot and each station associated with a portion of the slot having a constant width, and wherein a width of the slot at each station increases as an elevation of the inclined slot decreases such that a target moving down the inclined slot will fall through the slot when the width of the slot exceeds the diameter of the target, back into the target bin;

a target conveyor for delivering a captured target to said variable width slot;

a sensor for optically sensing when a target passes though a portion of said slot, and for sensing which portion of said slot said target passes though, said sensor capable of communicating a different signal depending upon which slot the target passes through; and a ticket dispensing mechanism for receiving said signal from said sensor and dispensing redeemable tickets in an amount determined by a signal received corresponding to a particular sized target.

2. The crane game of claim 1 wherein said value of said target associated with a size of said target.

3. The crane game of claim 1 wherein each target is color coded according to its value.

4. The crane game of claim 1 wherein the plurality of targets are located on a rotating playing field within the target bin.

* * * * *